US011666161B2

(12) United States Patent
Osiecki et al.

(10) Patent No.: US 11,666,161 B2
(45) Date of Patent: Jun. 6, 2023

(54) MODULAR MERCHANDISE DISPLAY

(71) Applicant: American Greetings Corporation, Cleveland, OH (US)

(72) Inventors: Scott Osiecki, Skaneateles, NY (US); Igor Chernyshev, Camillus, NY (US); Peter Maciulewicz, Auburn, NY (US); Donwoong Kang, Camillus, NY (US)

(73) Assignee: American Greetings Corporation, Cleveland, OH (US)

( * ) Notice: Subject to any disclaimer, the term of this patent is extended or adjusted under 35 U.S.C. 154(b) by 0 days.

(21) Appl. No.: 17/518,653

(22) Filed: Nov. 4, 2021

(65) Prior Publication Data

US 2022/0133062 A1 May 5, 2022

Related U.S. Application Data

(60) Provisional application No. 63/109,470, filed on Nov. 4, 2020.

(51) Int. Cl.

| | |
|---|---|
| ***A47F 7/00*** | (2006.01) |
| ***A47F 5/08*** | (2006.01) |
| ***A47F 7/28*** | (2006.01) |
| ***A47F 5/10*** | (2006.01) |
| ***A47B 96/06*** | (2006.01) |
| ***A47F 7/14*** | (2006.01) |

(52) U.S. Cl.

CPC ..... *A47F 7/0042* (2013.01); *A47B 96/067* (2013.01); *A47F 5/0815* (2013.01); *A47F 5/10* (2013.01); *A47F 5/103* (2013.01); *A47F 7/145* (2013.01); *A47F 7/28* (2013.01)

(58) Field of Classification Search

CPC ..... A47F 7/0042; A47F 5/0815; A47F 5/10; A47F 7/28; A47F 5/103; A47F 5/0062; A47F 7/145; A47F 5/0807; A47F 5/083; A47F 5/0838; A47F 5/0846; A47B 47/022; A47B 96/027; A47B 57/045; A47B 97/001; A47B 96/067; A47B 96/1408; A47B 96/14

USPC ..... 211/189, 52, 55, 94.01, 193, 103, 128.1

See application file for complete search history.

(56) References Cited

U.S. PATENT DOCUMENTS

| | | | | |
|---|---|---|---|---|
| 2,087,421 A * | 7/1937 | Williams | A47F 5/13 | 211/172 |
| 3,101,681 A * | 8/1963 | Streater | A47B 57/425 | 211/187 |
| 3,148,638 A * | 9/1964 | Shelor | A47B 96/04 | 108/108 |
| 3,173,386 A * | 3/1965 | Magers | A47F 7/148 | 248/220.31 |
| 3,200,961 A | 8/1965 | Kolster et al. | | |
| 3,335,874 A * | 8/1967 | Levy | A47F 7/144 | 211/187 |

(Continued)

*Primary Examiner* — Jennifer E. Novosad
(74) *Attorney, Agent, or Firm* — Christine Flanagan

(57) ABSTRACT

A modular merchandise display which allows for the integrated display of greeting cards and other social expression products. The system provides flexibility in the set up and modification of the retail display over time by offering product modules having a variety of holding mechanisms for retaining and displaying a wide range of products. Each product module operates independently from all others such that adding/removing/rearranging a product module does not affect or disrupt the other product modules on the display.

5 Claims, 15 Drawing Sheets

(56) References Cited

U.S. PATENT DOCUMENTS 3,534,863 A * 10/1970 Howard ..... A47F 7/163 211/47
3,830,374 A * 8/1974 Kassimir ..... A47F 5/103 211/1
3,971,477 A 7/1976 Bruderly
4,046,083 A * 9/1977 Murdoch ..... A47F 5/103 108/193
4,068,855 A * 1/1978 Hackett ..... A47F 5/13 211/189
4,228,906 A * 10/1980 Jones ..... A47F 5/0025 248/222.13
4,256,043 A * 3/1981 Ovitz, III ..... A47F 5/0876 108/29
4,655,353 A * 4/1987 Johnson ..... A47F 5/103 211/208
4,765,492 A * 8/1988 Howard ..... A47F 5/0025 211/55
4,801,023 A * 1/1989 Ecclestone ..... A47F 7/144 D6/678.3
4,887,783 A * 12/1989 Franklin ..... A47F 5/0815 248/225.11
4,949,849 A * 8/1990 Hardy ..... A47F 7/145 211/184
5,009,335 A * 4/1991 Jonker ..... A47F 7/145 D34/17
5,031,781 A * 7/1991 Price ..... A47F 7/163 211/128.1
5,305,898 A * 4/1994 Merl ..... A47F 5/0807 248/220.42
5,439,123 A * 8/1995 Nook ..... A47F 7/145 211/187
5,472,103 A * 12/1995 Merl ..... A47B 47/022 211/187
5,505,315 A * 4/1996 Carroll ..... A47F 1/125 211/59.3
5,511,675 A * 4/1996 Frederick ..... A47B 63/00 211/94.01
5,529,192 A * 6/1996 Conen ..... A47B 96/028 211/187
5,566,844 A * 10/1996 Bernardin ..... A47F 5/0846 211/208
5,607,070 A * 3/1997 Hellyer ..... A47F 5/0846 211/187
5,653,349 A * 8/1997 Dana ..... F16B 12/34 248/221.12
5,848,711 A * 12/1998 Schmit ..... A47B 96/00 312/246
5,918,750 A * 7/1999 Jackson ..... A47F 5/0807 108/108
6,164,467 A * 12/2000 DePottey ..... A47F 5/0846 52/36.5
6,427,857 B1 8/2002 Adams et al.
6,659,295 B1 * 12/2003 De Land ..... A47B 96/04 211/187
6,935,523 B2 8/2005 Ahn
6,978,906 B2 12/2005 Wishart et al.
7,175,034 B2 2/2007 Nook et al.
7,270,242 B2 * 9/2007 Liu ..... A47B 47/024 248/188.8
7,428,972 B2 * 9/2008 Warner ..... A47F 5/0823 211/94.01
7,641,063 B2 1/2010 Wishart et al.
7,775,379 B2 * 8/2010 Hodge ..... A47F 7/144 100/61
7,841,676 B2 11/2010 Hawkins
7,886,916 B2 * 2/2011 Alyn ..... A47F 5/10 211/55
7,900,784 B1 * 3/2011 Weigand ..... A47F 5/005 211/186
8,191,719 B2 * 6/2012 van Ooyen ..... A47F 5/08 211/175
8,312,998 B2 * 11/2012 Theisen ..... A47F 7/148 211/128.1
8,919,579 B2 * 12/2014 Weigand ..... A47F 7/144 211/186
9,357,857 B2 * 6/2016 Brozak ..... A47F 5/10
9,918,567 B2 * 3/2018 Pena ..... A47F 5/0807
10,334,970 B2 * 7/2019 Buck ..... A47B 57/406
10,617,229 B1 * 4/2020 Stafford ..... A47F 5/005
10,905,259 B2 * 2/2021 Spain, Jr. ..... A47F 5/083
10,939,756 B2 * 3/2021 Peck ..... A47B 96/024
11,103,068 B1 * 8/2021 Koeppel ..... A47B 97/001
11,197,563 B1 * 12/2021 Brenner ..... A47F 5/0815
2001/0025823 A1 * 10/2001 Brozak ..... A47F 7/17 211/128.1
2003/0192842 A1 * 10/2003 Suttles ..... A47B 55/02 211/94.01
2005/0067362 A1 * 3/2005 Martin ..... A47F 5/005 211/184
2005/0081412 A1 4/2005 Malkovas
2005/0139561 A1 * 6/2005 Ohkubo ..... A47F 5/0062 211/186
2005/0230338 A1 * 10/2005 Farinola ..... A47F 5/0838 211/186
2005/0263466 A1 * 12/2005 Libman ..... A47F 5/0815 211/106
2005/0284830 A1 * 12/2005 Snyker ..... A47F 5/103 211/133.4
2007/0170126 A1 * 7/2007 Singer ..... A47F 7/145 211/55
2007/0267375 A1 * 11/2007 Battaglia, ..... A47B 47/03 211/189
2008/0078728 A1 4/2008 Hodge
2008/0237159 A1 * 10/2008 Bray ..... A47F 5/101 211/59.2
2012/0318759 A1 * 12/2012 Buettner ..... A47F 7/147 211/55
2014/0149242 A1 5/2014 Turner et al.
2015/0129528 A1 * 5/2015 Brozak ..... A47B 47/05 211/186
2015/0173528 A1 6/2015 Hester-Redmond
2018/0244293 A1 * 8/2018 Murray ..... A47F 13/00
2019/0387875 A1 12/2019 Peck et al.
2020/0069083 A1 3/2020 Spain, Jr.
2022/0133062 A1 * 5/2022 Osiecki ..... A47F 5/0815 211/45
2022/0139272 A1 * 5/2022 Santarelli ..... A47F 5/08 40/606.01

* cited by examiner

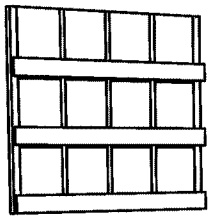
FIG. 2A
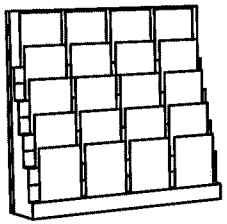
FIG. 2B
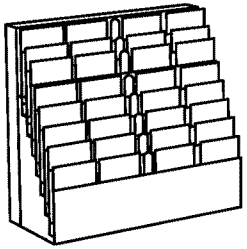
FIG. 2C
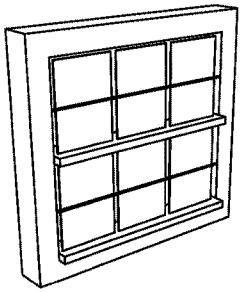
FIG. 2D
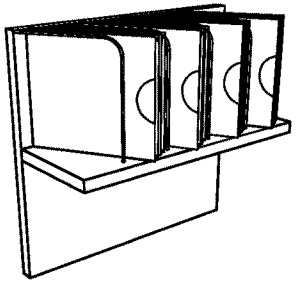
FIG. 2E
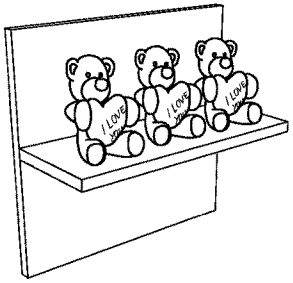
FIG. 2F
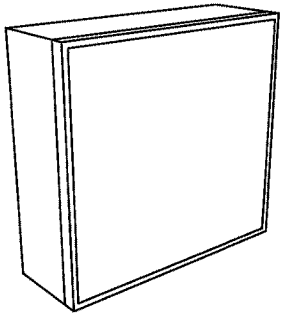
FIG. 2G
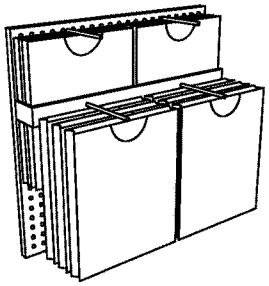
FIG. 2H
FIG. 2I
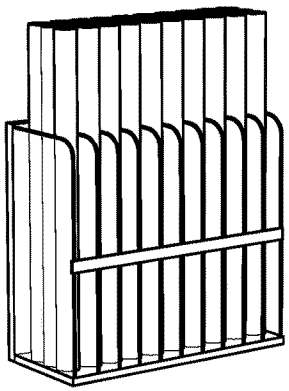
FIG. 2J
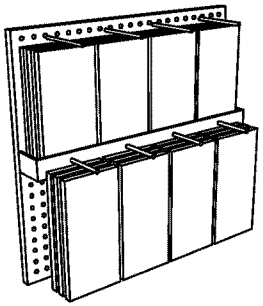
FIG. 2K

MODULAR MERCHANDISE DISPLAY

RELATED APPLICATIONS

This application is a non-provisional of and claims priority to U.S. Provisional Patent Application No. 63/109,470, filed on Nov. 4, 2020, a copy of which is incorporated herein by reference in its entirety.

FIELD OF THE INVENTION

The present disclosure and related inventions are in the field of retail display fixtures. More specifically, retail display fixtures for storing and displaying social expression products such as greeting cards, gift wrap, gift bags, and other such product.

SUMMARY OF THE INVENTION

The modular merchandise display of the present disclosure and related inventions includes: a plurality of module bars attached between two slotted uprights of a merchandise display frame; and a plurality of product modules, each of the plurality of product modules removably attachable to one of the plurality of module bars. The plurality of product modules are operative to display one of greeting cards, gift bags, stickers, gift wrap, plush or novelty items, and the plurality of product modules are operative to each be selectively added or removed without disrupting other product modules attached to the plurality of module bars.

In another embodiment, the modular merchandise display includes: a base deck; a merchandise display frame supported by the base deck, the merchandise display frame comprising at least two slotted uprights with each slotted upright having a first end and a second end, a first rail attached between the first end of the at least two slotted uprights and a second rail attached between the second end of the at least two slotted uprights, creating a rectangular shape; a pegboard panel inserted between the at least two slotted uprights and first and second rails of the merchandise display frame; one or more module bars attached between the at least two slotted uprights or to the pegboard panel; and one or more product modules removably attached to the one or more module bars. The one or more product modules are operative to each be selectively added or removed without disrupting any other product modules attached to the plurality of module bars or to the pegboard panel.

In still another embodiment, the modular merchandise display includes: a base; a merchandise display frame attached to the base, the merchandise display frame having two (2) long sides and (2) short sides arranged in a rectangular shape; at least one module bar attached between the two (2) long sides of the merchandise display frame; and at least one product module attached to the at least one module bar where the at least one product module is operative to support and display greeting cards or other social expression products.

DESCRIPTION OF THE DRAWINGS

FIG. 2A is a perspective view of a full-face card module.

FIG. 2B is a perspective view of a 5-step card module.

FIG. 2C is a perspective view of a flip system module.

FIG. 2D is a featured cards module.

FIG. 2E is a value bag module.

FIG. 2F is a plush shelving module.

FIG. 2G is a graphic/light box/screen module.

FIG. 2H is a gift bag module.

FIG. 2I is a pop-up card module.

FIG. 2J is a roll wrap module.

FIG. 2K is a tissue paper module.

DETAILED DESCRIPTION OF PREFERRED AND ALTERNATE EMBODIMENTS

Figure 1:
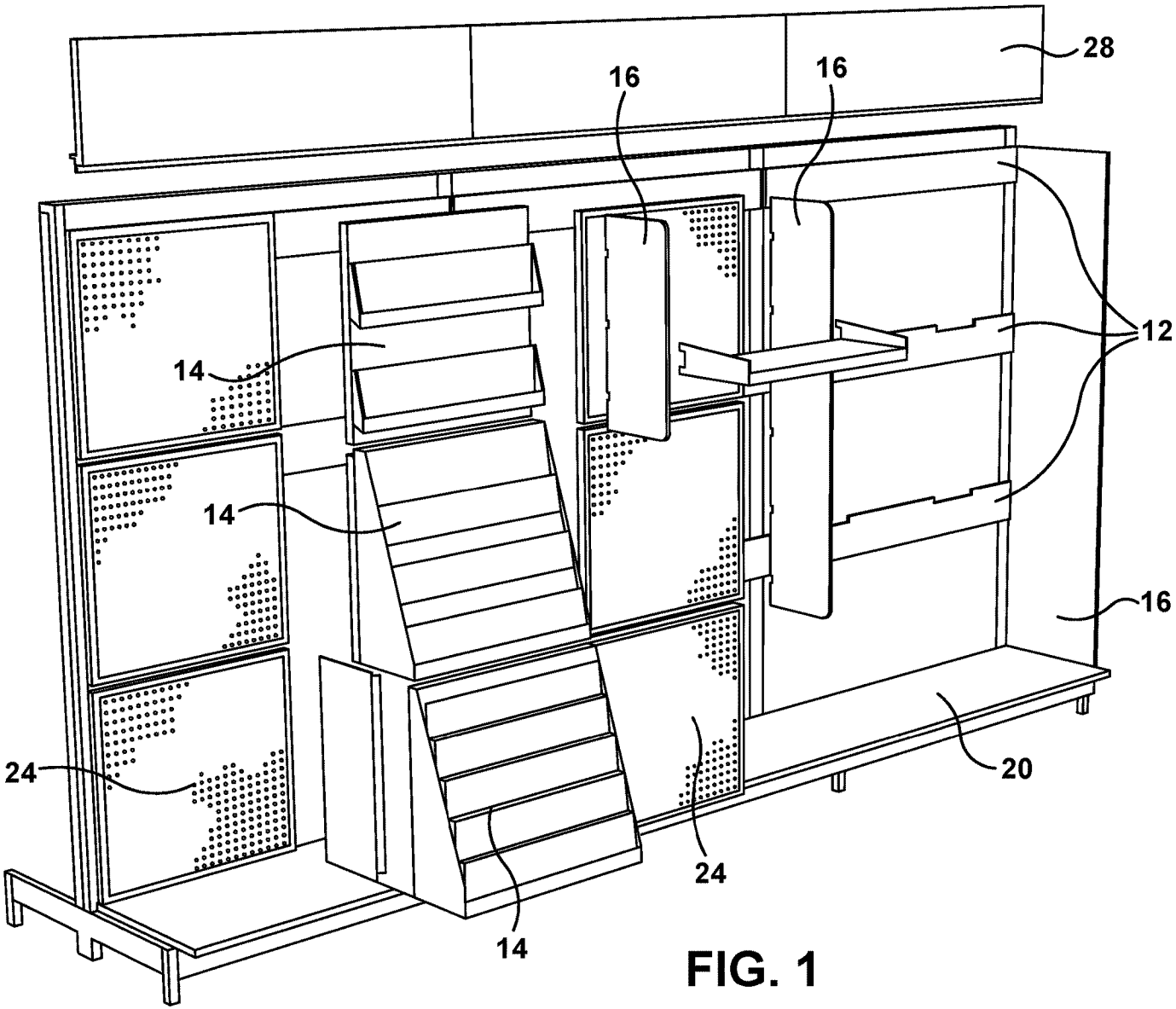
FIG. 1 is a perspective view of the main components of the modular merchandise display.

The present disclosure and related inventions describe a modular merchandise display which allows for the display of greeting cards along with other social expression products. The integration of greeting cards with other related merchandise allows for an easier shopping experience and may possibly encourage cross selling of related products. It also provides maximum flexibility in arranging and rearranging such products on the display due to seasonality changes or promotional needs.

The modular retail display 100 of the present disclosure and related inventions includes a system of components that can be arranged in different configurations to suit the needs of a retailer in displaying social expression products. This display includes but is not limited to a merchandise display frame (hereinafter referred to as "display frame") 22; module bars 12; product/communication modules (hereinafter referred to as "product modules") 14; divider panels or blades 16; headers 18; and a base deck or storage space 20. This display 100 can be used in connection with an existing freestanding vertically upright frame for displaying merchandise, sometimes referred to as a gondola, or with proprietary structures designed specifically for use with this system. The modular retail display 100 will be described herein with respect to a specific display frame 22 created for the modular retail display 100 and shown in FIG. 3 (along with base deck or storage system 20) but it is to be understood that the modular retail display 100 can be used with existing upright merchandise fixtures or gondolas.

Figure 3:
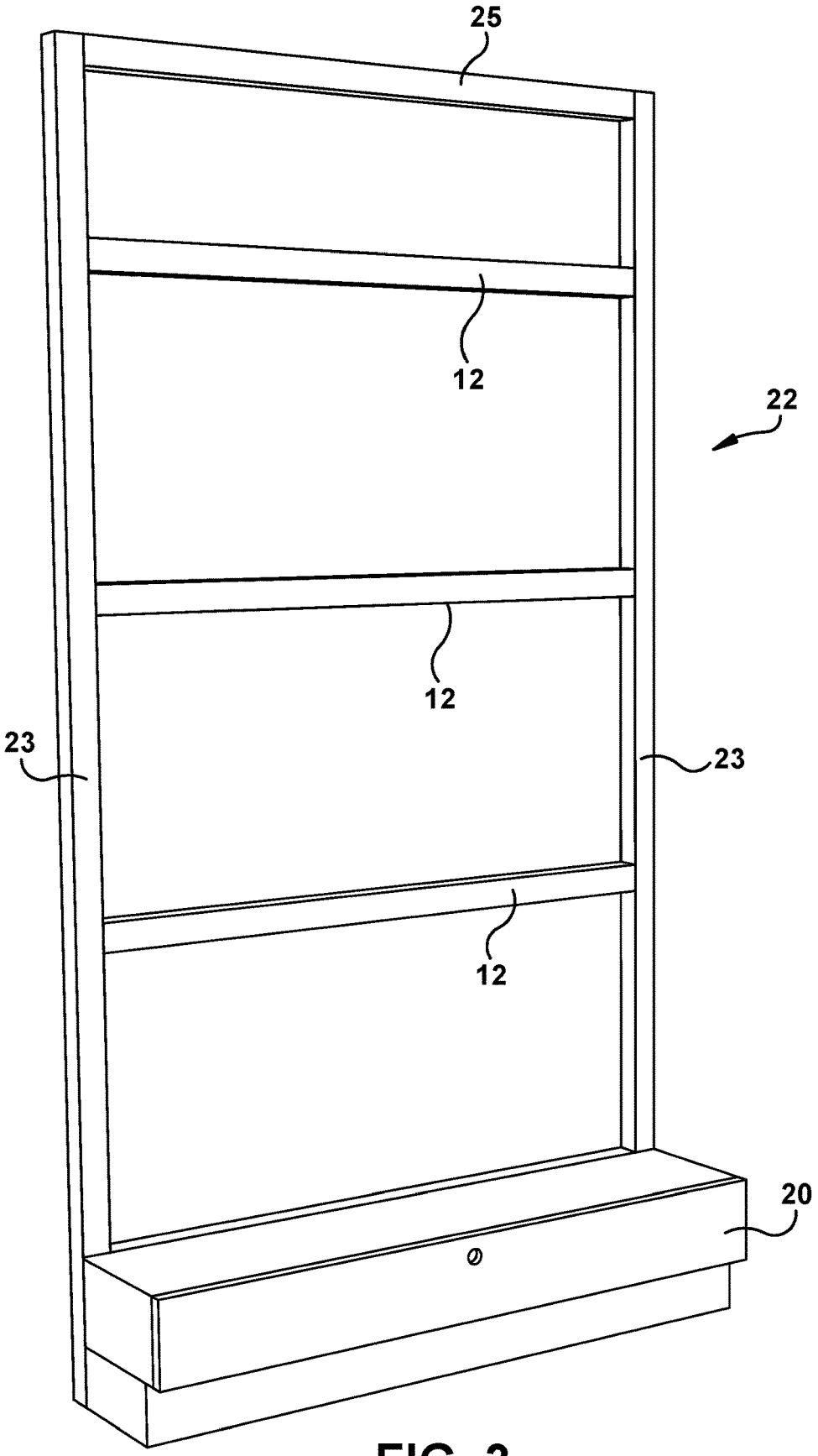
FIG. 3 is a perspective view of a display frame and base or storage module.
Figure 4:
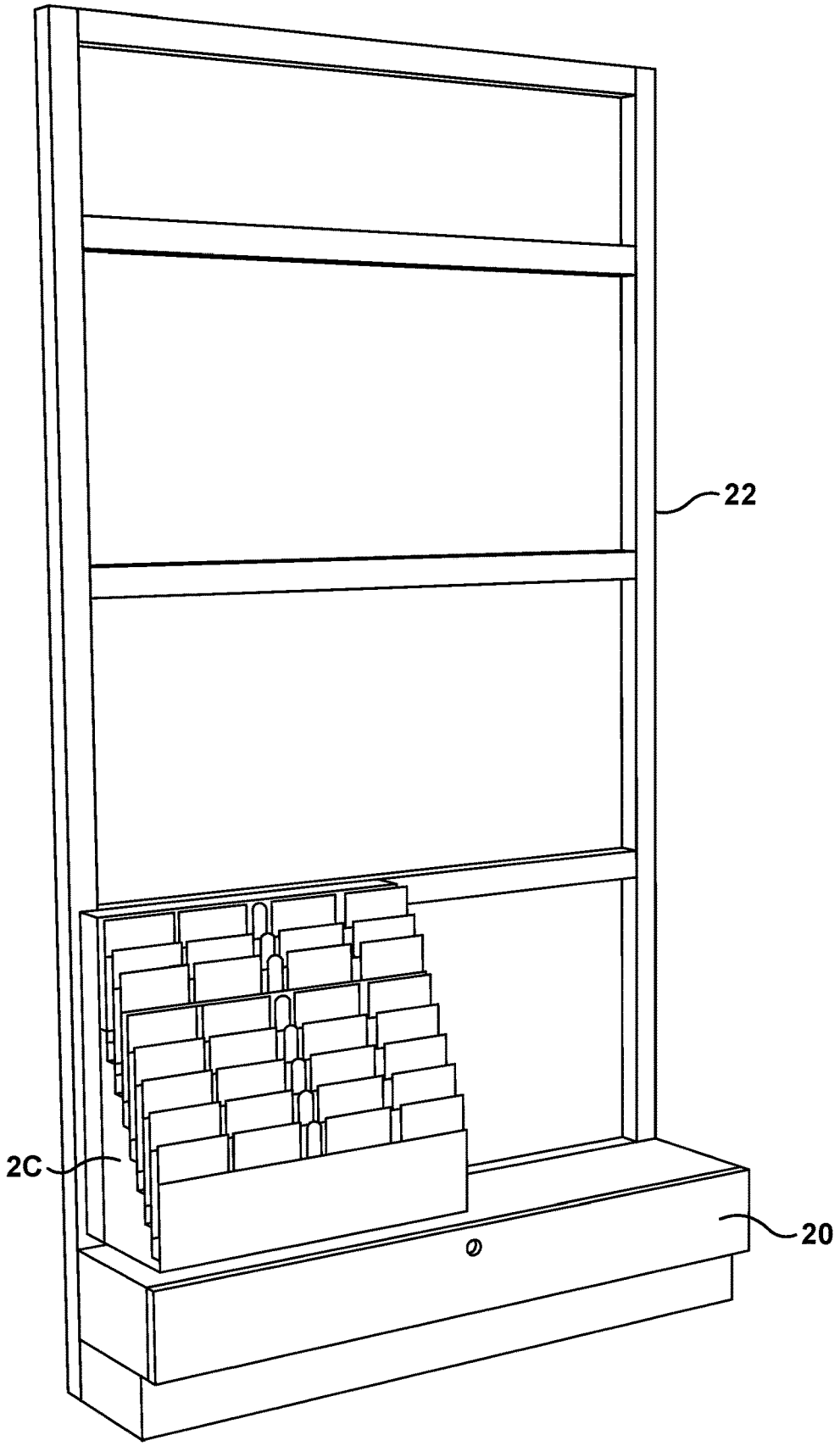
FIG. 4 is a perspective view of FIG. 3 with flip system module.
Figure 5:
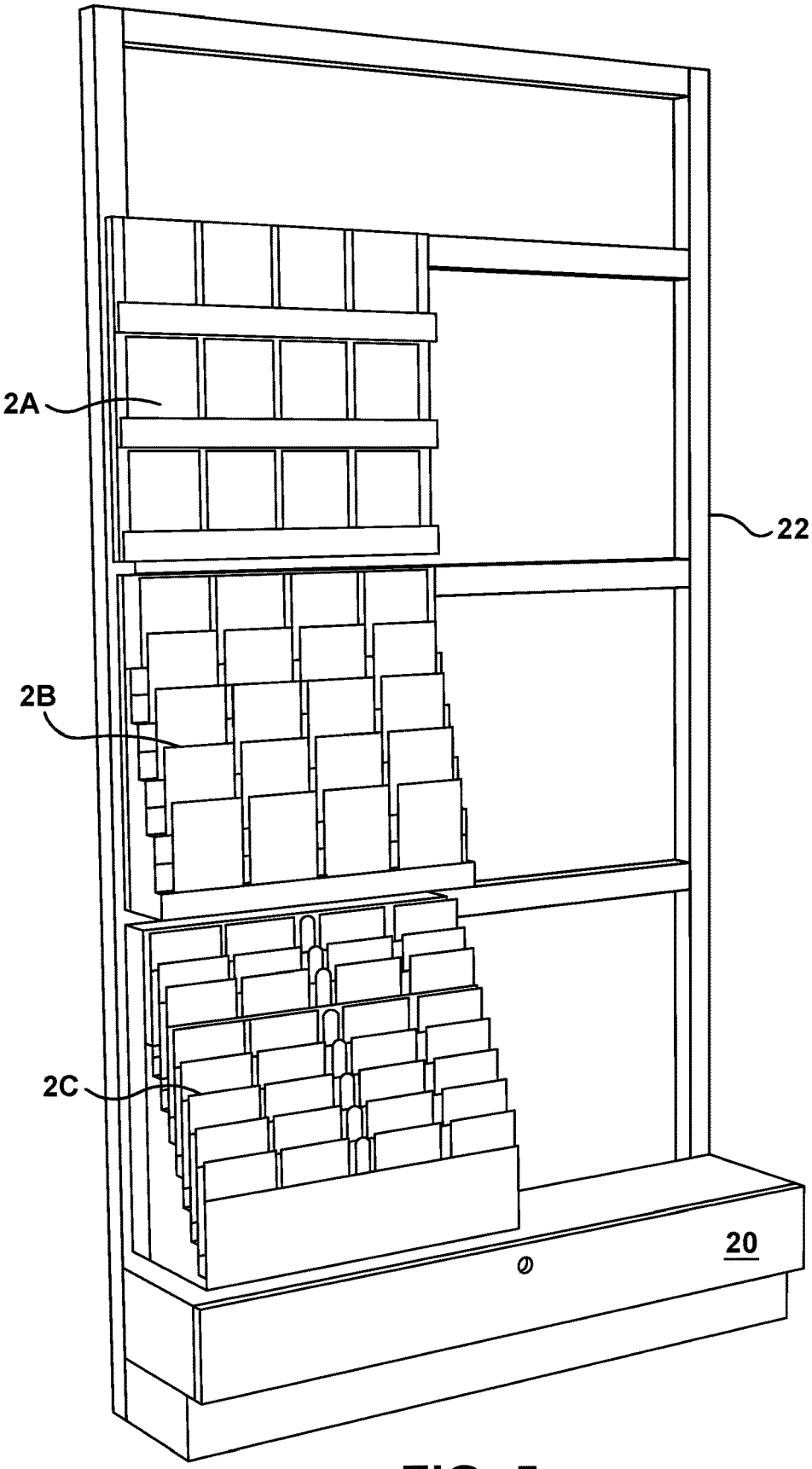
FIG. 5 is a perspective view of FIG. 4 with 5-step card module and full face card module.
Figure 6:
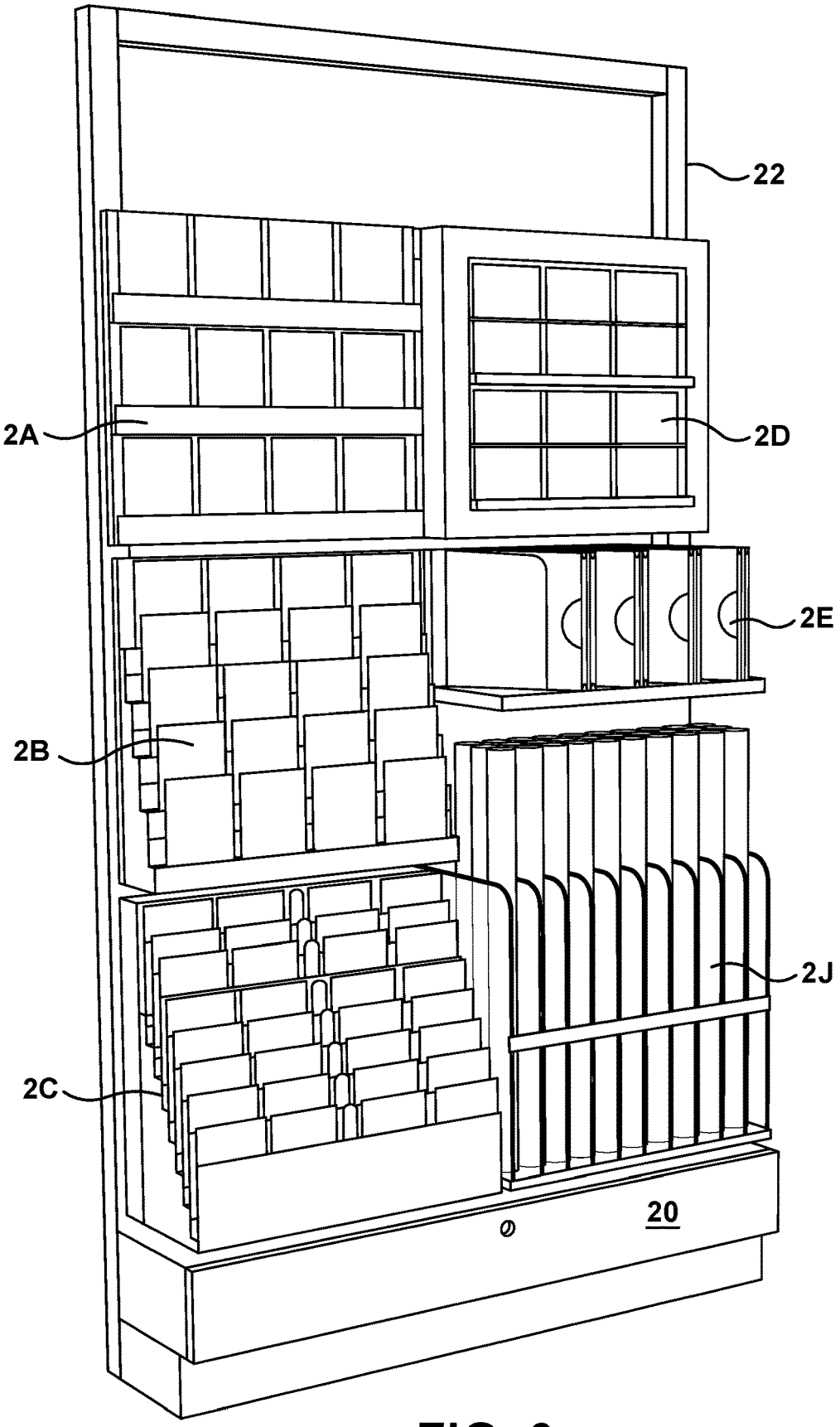
FIG. 6 is a perspective view of FIG. 5 with a roll wrap module, value bag module, and featured cards module.

One example of a display frame 22 which can serve as the support for the modular retail display 100 of the present disclosure and related inventions, is shown in FIG. 3. The display frame 22 includes two (2) spaced-apart slotted upright members 23 which generally define the width and height of the display frame 22, each spaced-apart slotted upright member 23 having a first end and a second end opposite the first end. A first rail 25 is attached between the first ends of the two (2) spaced-apart slotted upright members 23 and a second rail 27 is attached between the second ends of the two (2) spaced-apart slotted upright members 23, thereby creating a substantially rectangular display frame 22. A pegboard panel 24 is attached to the inner surface of the rectangular display frame 22, as shown in FIG. 1. There is also a base deck 20 by which the display frame 22 may be supported. One or more base frames 22 may be attached to create a larger overall display (see FIGS. 8-14) Again, while this display frame 22 is described and shown in the figures as having the above-detailed attributes, the modular retail display 100 of the present disclosure and related inventions may also be used with existing various greeting card display frames or gondolas.

Module bars 12 facilitate attachment of the product modules 14 to the display frame 22. They are hung between two (2) slotted upright members 23 of a the display frame 22, as shown in FIG. 3 (over the pegboard panel 24). Each module bar 12 may be attached directly to the slotted upright members 23, to the pegboard panel 24, or both 23, 24. The module bars 12 can also be designed to extend along the Z-axis so that the product modules 14 can be used on differing depth gondola/fixtures bases. Each module bar 12 is a substantially rectangular steel panel which may have various cutouts or tabs along the edges thereof for facilitating secure attachment of the product modules 14 to the module bar 12. Typically, one (1) module bar supports 12 one (1) product module 14, although longer module bars 12 can be used to support two (2) or more product modules 14.

The product modules 14 of the present disclosure and related inventions can be configured to accommodate different product display needs, both horizontally and vertically by providing a variety of display-hanging solutions. Product modules 14 can be added, removed, or interchanged with having to disrupt or move other product modules 14 or fixtures attached to the base frame 22 and without having to tear down and rebuild the entire display 100. Each product module 14 contains the same hanger hardware to attach to the module bars 12, described above. Some product modules 14 are 2-feet by 2-feet square modules, however, the product modules 14 may come in a variety of sizes with different holding systems for retaining a variety of merchandise (see FIG. 2). Each product module 14 contains a particular holding system depending on the type of merchandise to be displayed on said product module 14. There are various product modules 14 for displaying greeting cards in particular configuration, depending on need. For example, there are product modules 14 for displaying full-faced greeting cards, as shown in FIG. 2A (for fewer card groupings and ease of selection), stepped or tiered greeting card display modules, as shown in FIG. 2B (for displaying at least a portion of a larger number of greeting cards than the full-faced module), flip card displays, as shown in FIG. 2C (for a more dense card display), featured card displays, as shown in FIG. 2D (for highlighting a fewer number of cards which may be, for example, new cards, seasonal cards, promotional cards, etc.), and pop-up card modules, as shown in FIG. 2I, (which require more space per card to show the 3D nature of the pop-up cards). There are also product modules 14 for displaying non-greeting card merchandise. Examples include but are not limited to: a value bag module, as shown in FIG. 2E, for displaying value gift bags in a vertical slotted arrangement; plush shelving, as shown in FIG. 2F, for displaying teddy bears or other such items on a shelf; a gift bag module, as shown in FIG. 2H, for displaying gift bags in a front facing waterfall arrangement; a roll wrap module, as shown in FIG. 2J, for displaying roll wrap in a vertical configuration; a tissue paper module, as shown in FIG. 2K, for displaying hanging packages of tissue paper, and a graphic/light box screen module, as shown in FIG. 2G, for displaying graphics and having such graphics illuminated or backlight by a light inserted behind the screen. The graphic/light box screen module can also be used for storage (behind the screen). Product modules 14 may contain various shelving options for the display of other social expression products, including, but not limited to: gift bags; stickers; stationery; plush or novelty items; pop-up cards (which require more space per card to show the 3D nature of the pop-up cards); tissue paper; bows and ribbons; flat gift wrap; and roll gift wrap. Any product module 14 may also contain pegboard for displaying hanging merchandise (via pegboard hanger) or have a graphic card over the front surface thereof for signage or advertisements. Shadow box product modules contain an inner cavity for storage of additional product, system parts or supplies, etc. A product module 14 can be designed to display virtually any type of greeting card or social expression product. The sides of each product modules 14 are designed to receive a system of divider panels 16 (discussed in further detail below) that can be added and removed to isolate areas of the display 100 or to provide communications to aid shopping navigation, seasonal messages, or sales promotions.

Figure 10:
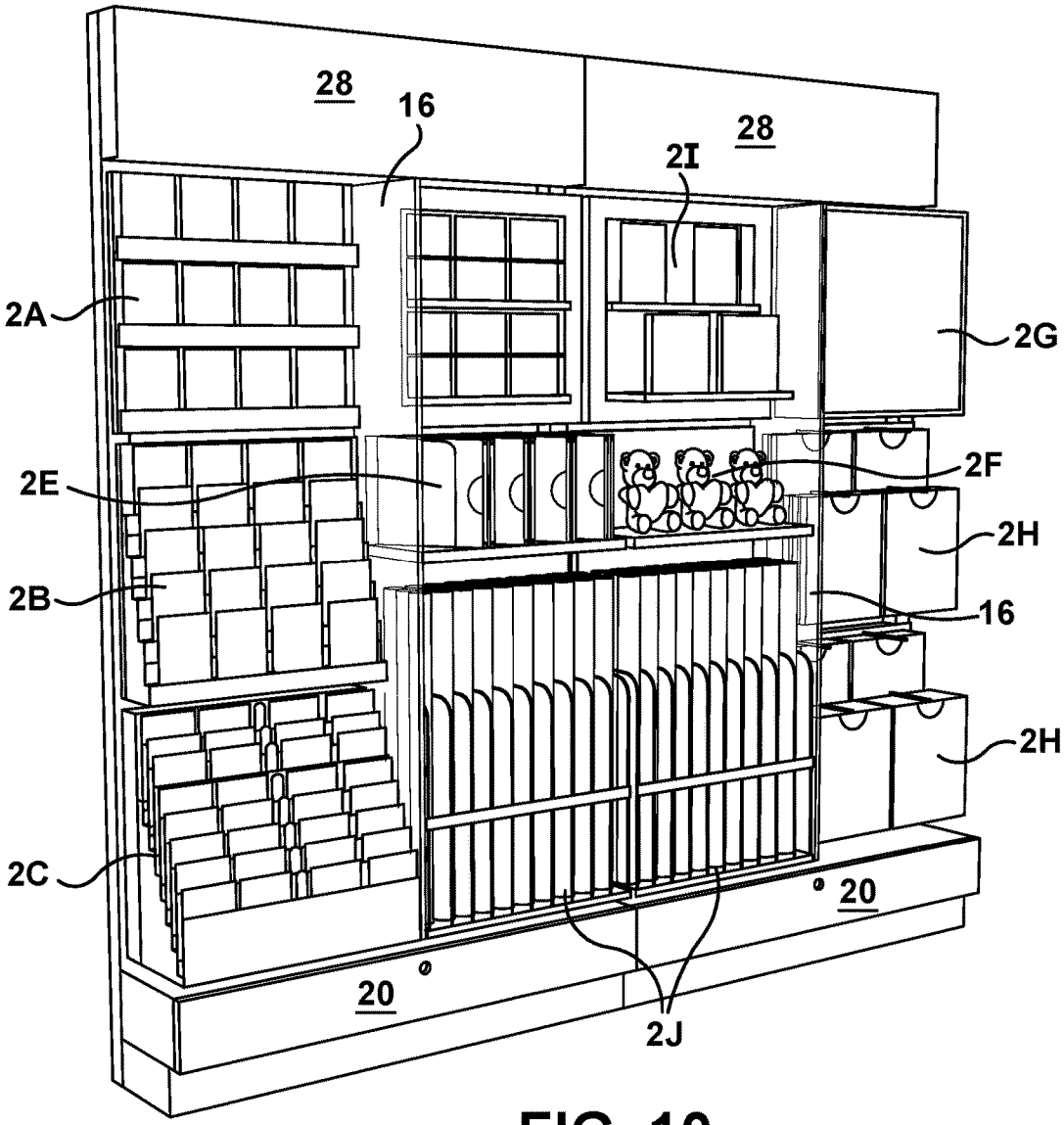
FIG. 10 is a perspective view of FIG. 9 with two (2) divider panels added.
Figure 11:
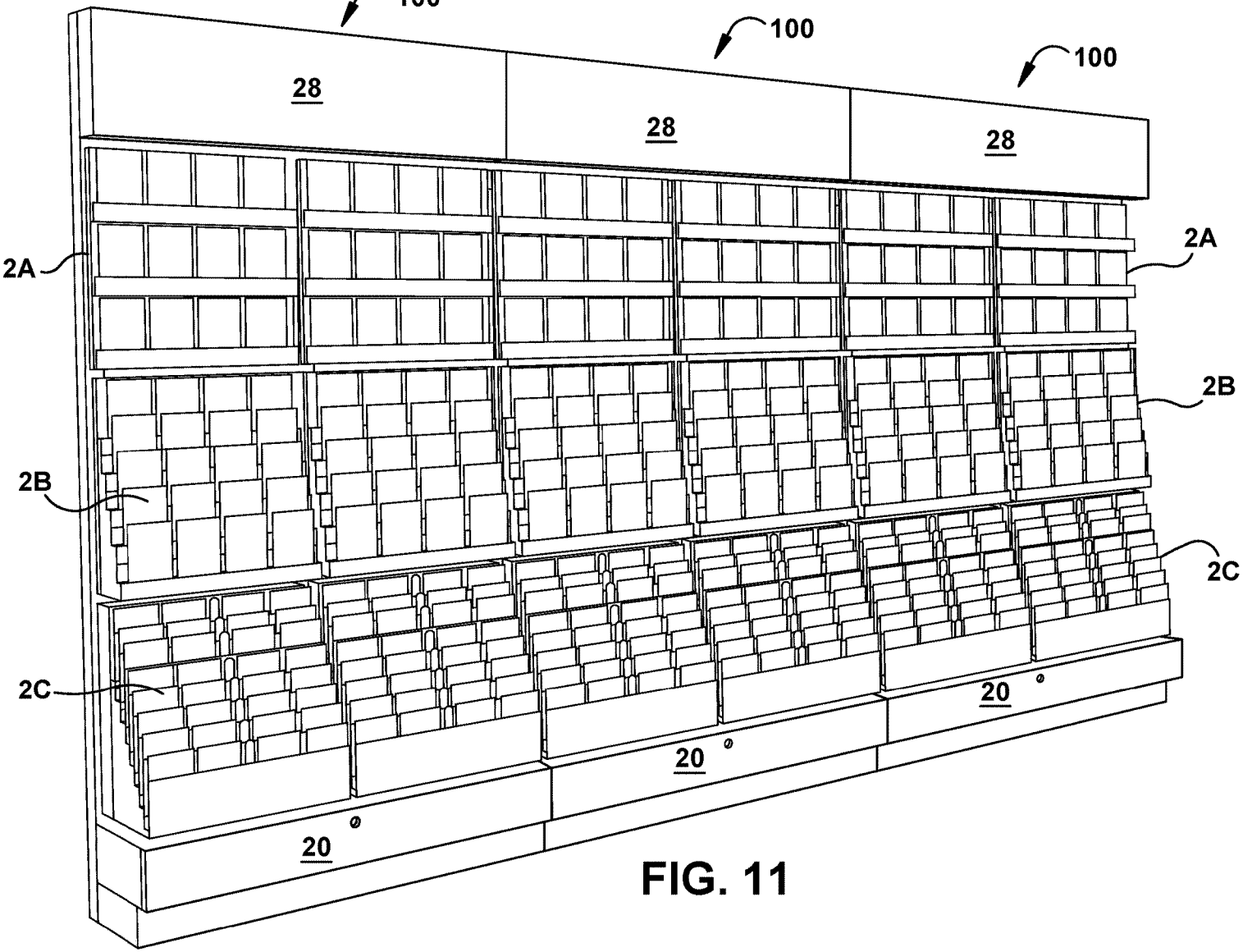
FIG. 11 is an example of a display configuration.
Figure 12:
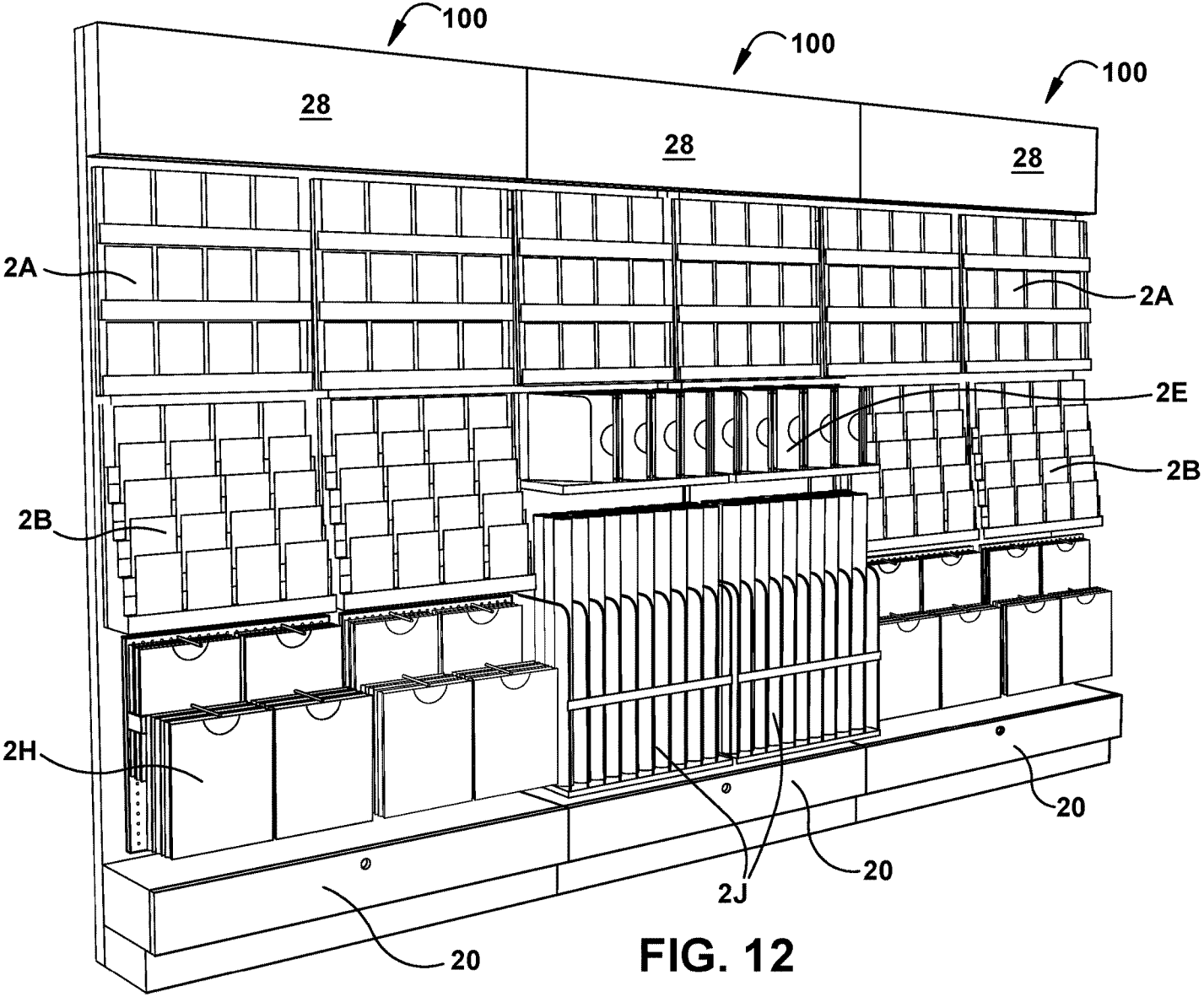
FIG. 12 is an alternate example of a display configuration.
Figure 13:
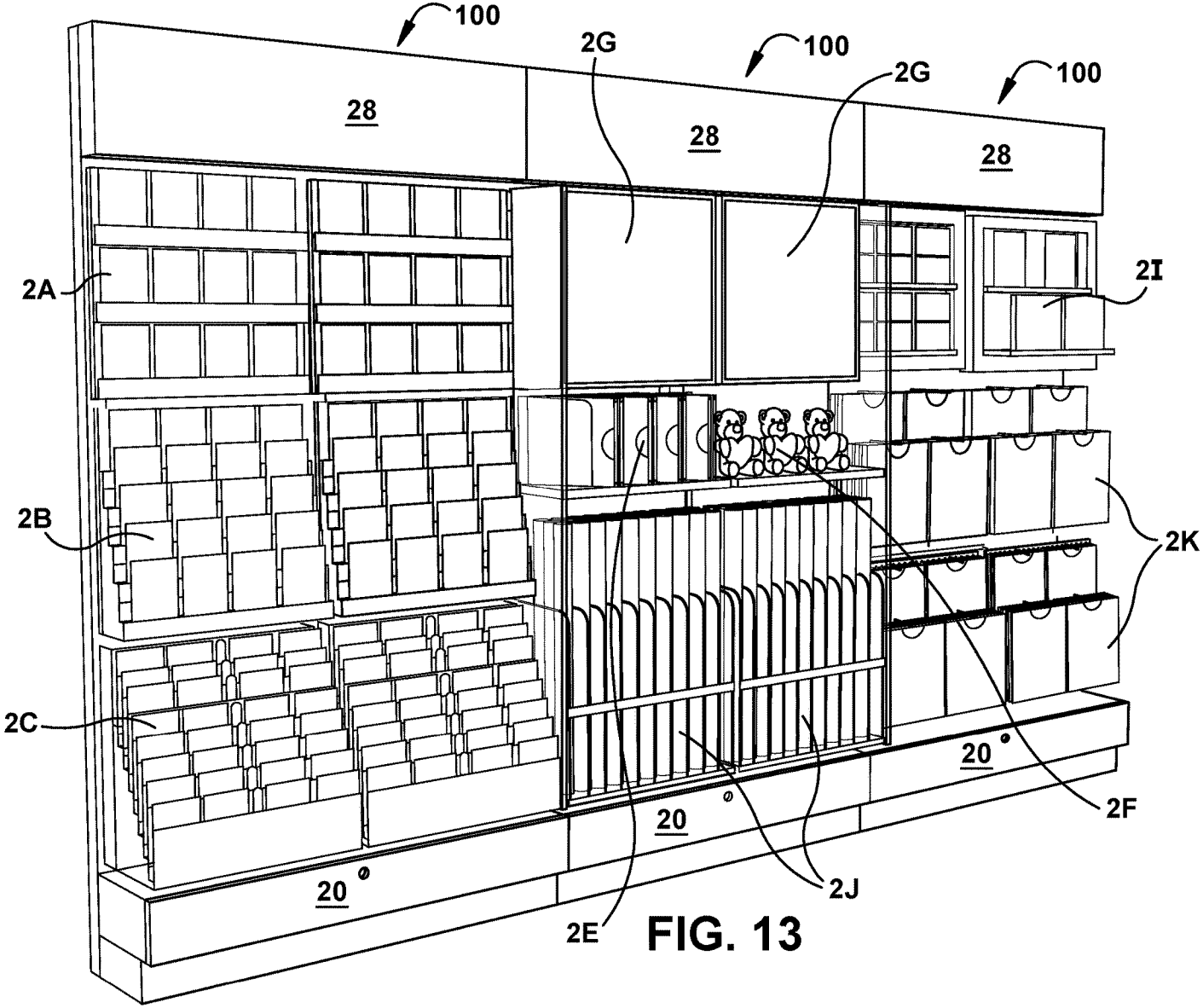
FIG. 13 is an alternate example of a display configuration.
Figure 14:
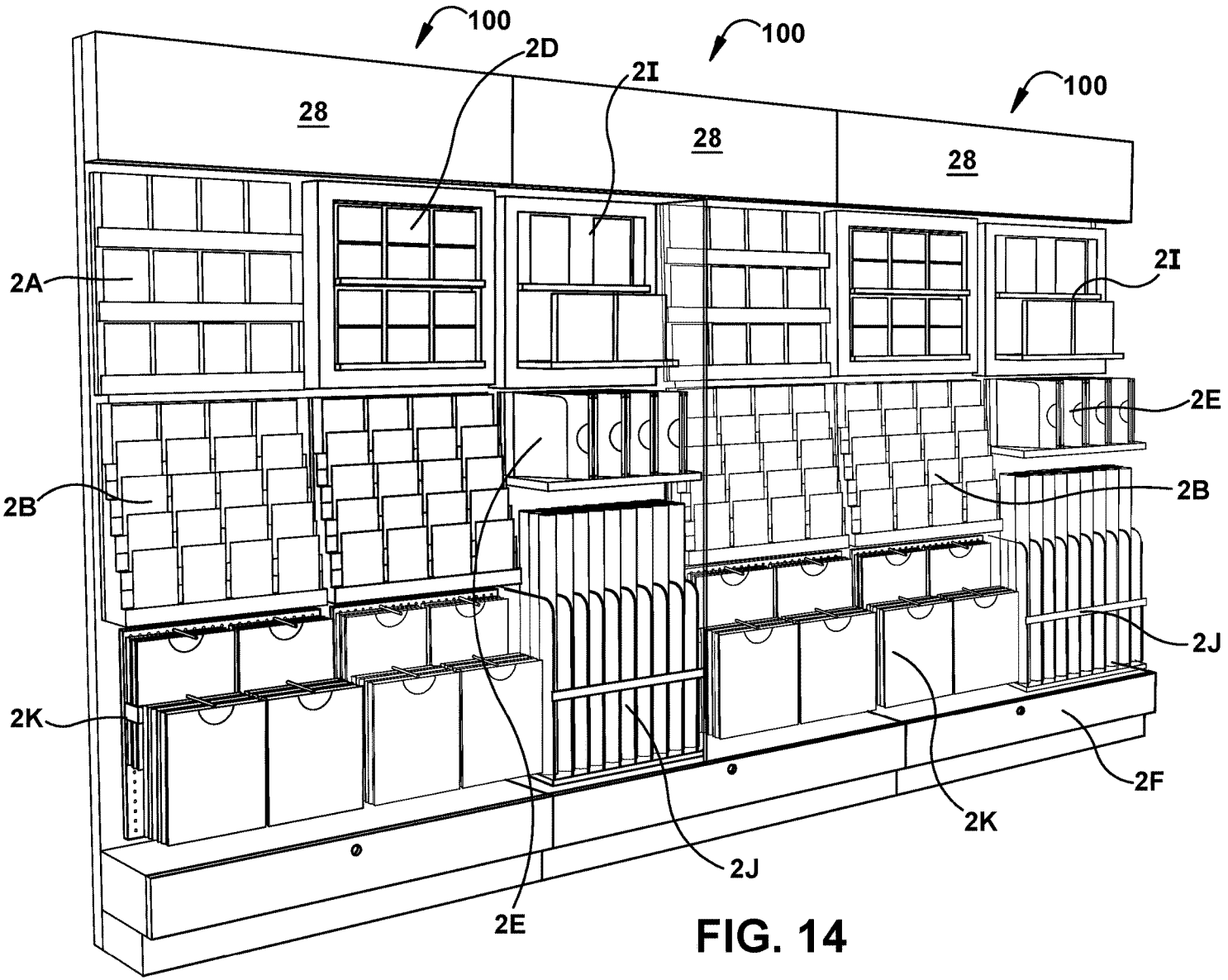
FIG. 14 is an alternate example of a display configuration.
Figure 15:
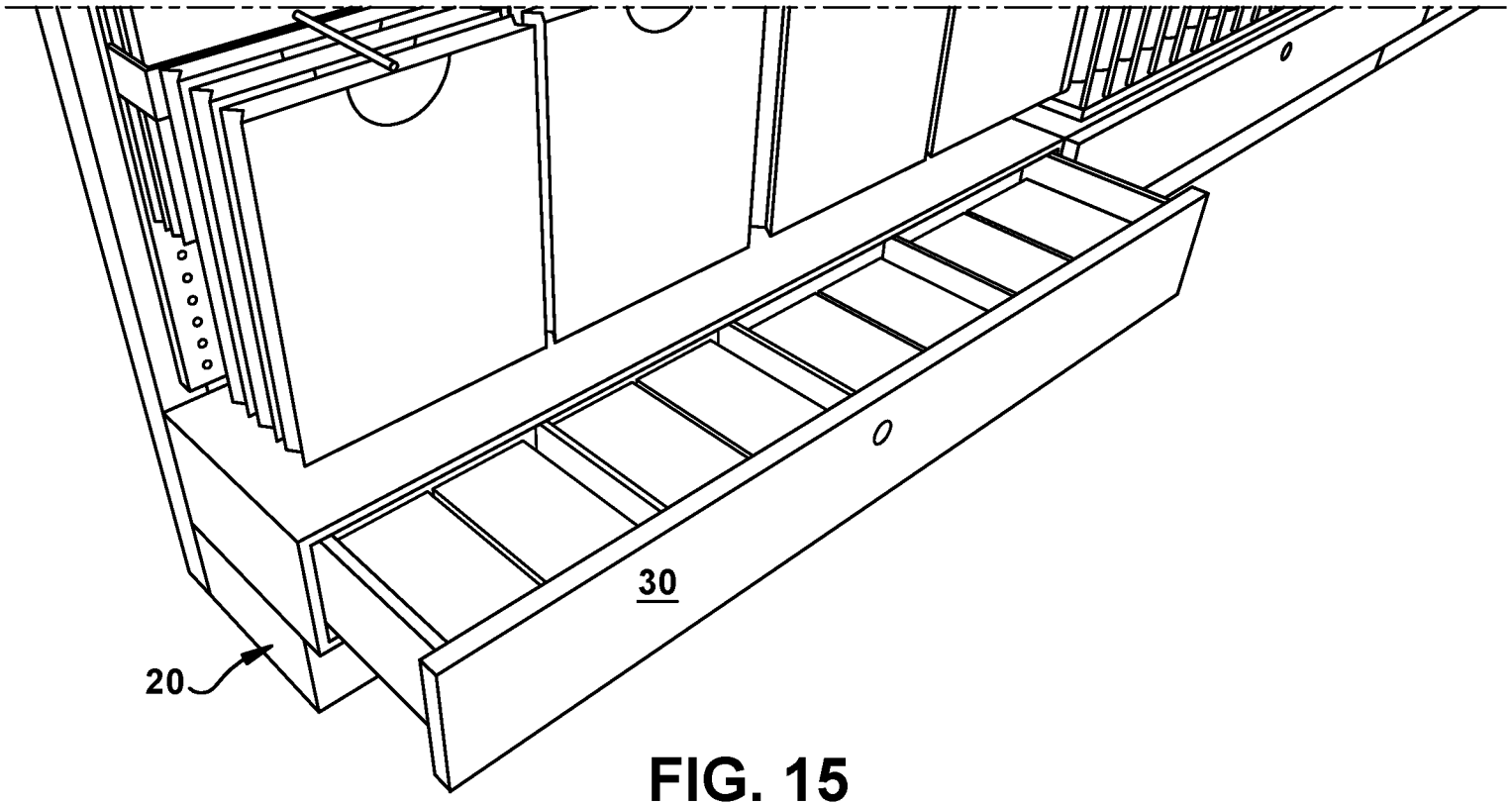
FIG. 15 is a perspective view of a base deck or module.

Divider panels or blades 16, as shown in FIG. 10 are vertical panels that can be used to divide certain display areas on the display 100 or to display signage 26 such as seasonal, promotional or category messages. Divider panels 16 may be made in a variety of shapes and sizes to help segment the product assortment and communicate with shoppers via signage. The divider panels or blades 16 are universal and can be attached between product modules 14 by locking onto a series of pins evenly spaced vertically along the sides of each product module 14, as. Divider panels 16 can be arranged and rearranged at any time without removing product modules 14 or disrupting the displayed merchandise.

Figure 7:
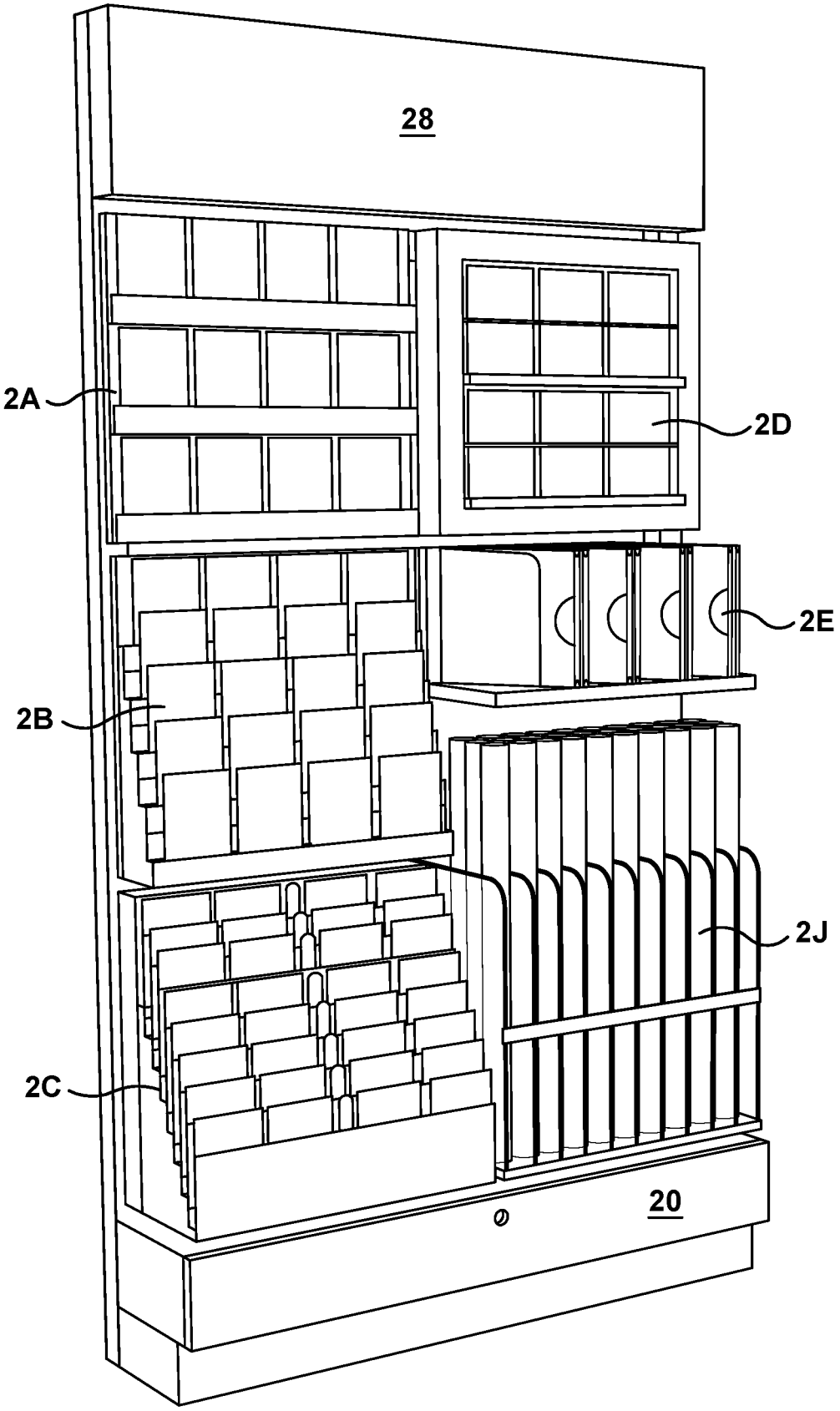
FIG. 7 is a perspective view of FIG. 6 with header.
Figure 8:
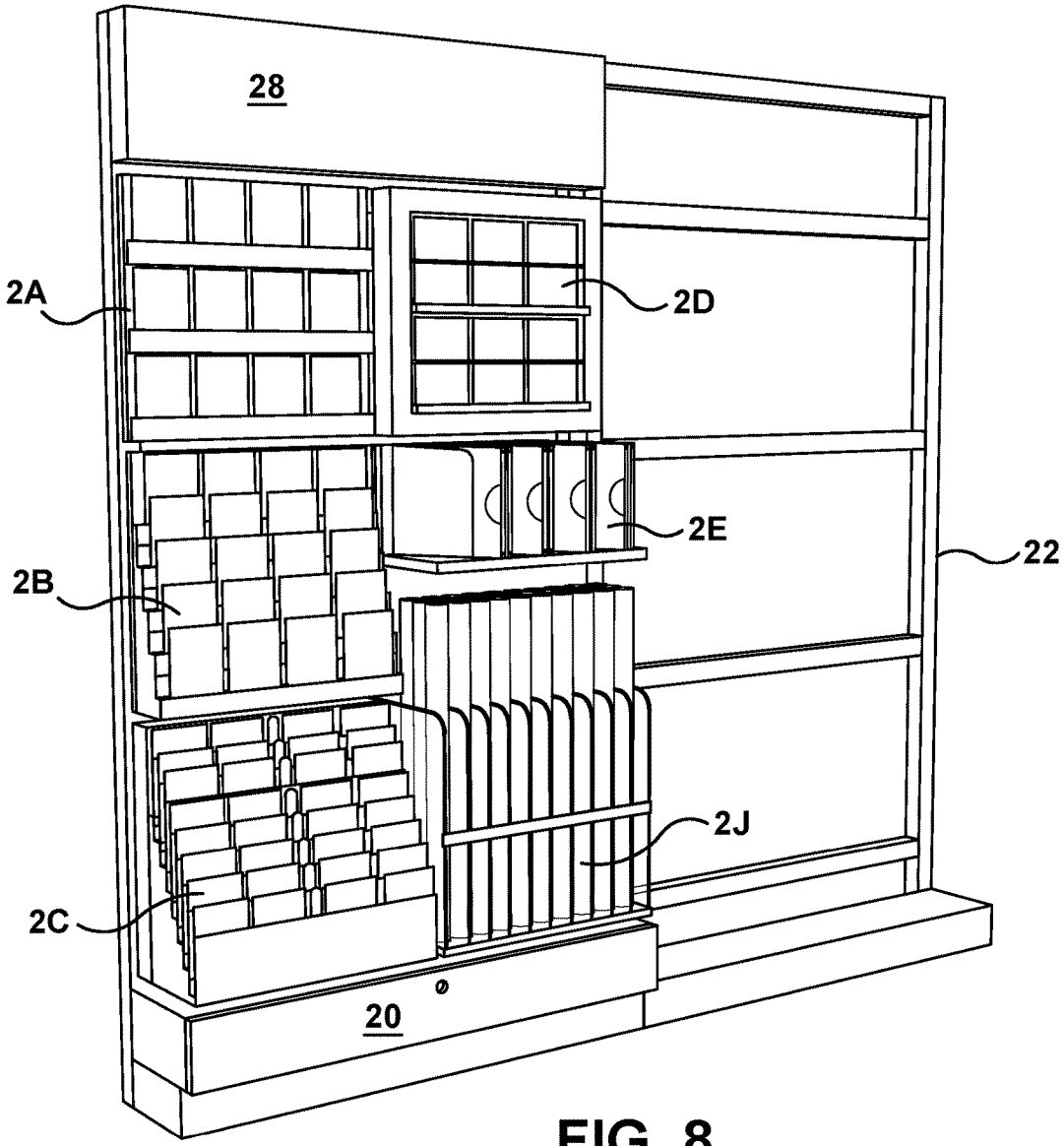
FIG. 8 is a perspective view of FIG. 7 with additional display frame added.
Figure 9:
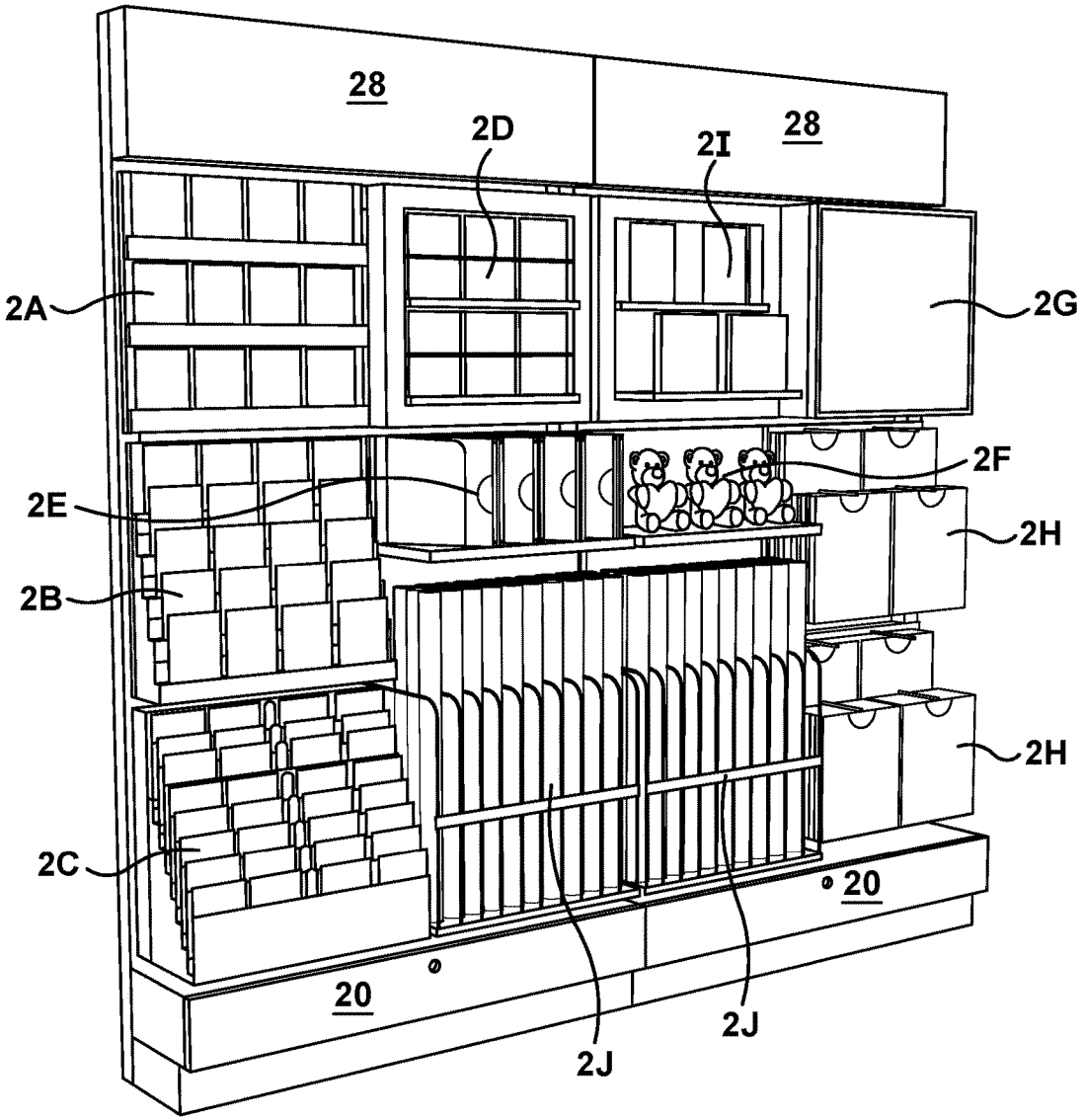
FIG. 9 is a perspective view of FIG. 8 with roll wrap module, plush shelving module, pop-up card module, gift bag module, and graphic/light box/screen module added to the second frame.

The modular merchandise display 100 may additionally include a header system. A header 28 may hang from a module bar 12 at the vertical top of the display frame 22, as shown in FIG. 7, to announce merchandise categories, occasions, or themes.

A base deck 20 is attached to the lower end of the display frame 22. It supports the display frame 22 and may support product or some lower placed product modules 14 and it can also be used as a storage space for unused product modules 14 and product. The base deck 20 may contain a panel or door 30 at the front thereof which may open like a drawer or hinge downward to provide access to the interior storage space.

While the modular merchandise display of the present disclosure and related inventions has been described herein with to a certain frame and module types, other frame types (gondola, endcap, etc.) and module attachments (other hanging or merchandise display methods) have been contemplated and are considered to be within the scope of the present invention.

The foregoing embodiments of the present invention have been presented for the purposes of illustration and description. These descriptions and embodiments are not intended to be exhaustive or to limit the invention to the precise form disclosed, and obviously many modifications and variations are possible in light of the above disclosure. The embodiments were chosen and described in order to best explain the principle of the invention and its practical applications to thereby enable others skilled in the art to best utilize the invention in its various embodiments and with various modifications as are suited to the particular use contemplated. It is intended that the invention be defined by the following claims.

The invention claimed is:

1. A modular merchandise display comprising:

a first slotted upright and a second slotted upright opposite the first slotted upright, the first and second slotted uprights having a first end and a second end opposite the first end;

a first horizontal rail and a second horizontal rail opposite the first horizontal rail, the first horizontal rail attached between the first ends of the first and second slotted uprights, and the second horizontal rail attached between the second ends of the first and second slotted uprights, creating a substantially rectangular merchandise display frame;

a pegboard panel attached to the inside surface of the merchandise display frame;

a plurality of module bars attached between two slotted uprights of a merchandise display frame, over the pegboard panel, each of the plurality of module bars having one or more cutouts or tabs along the upper edge thereof;

a plurality of product modules;

a plurality of identical hanger hardware, each of the plurality of identical hanger hardware attached to a rear surface of each of the plurality of product modules, the plurality of identical hanger hardware being attached to the one or more cutouts or tabs along the upper edge of one of the plurality of module bars;

wherein the plurality of product modules are operative to each be selectively added or removed without disrupting other product modules attached to the plurality of module bars.

2. The modular merchandise display of claim 1, wherein the plurality of product modules can be selected from the list of [ . . . ] a value bag module, plush shelving, gift bag module, roll wrap module, tissue paper module, and light box screen module.

3. The modular merchandise display of claim 1 further comprising one or more divider panels inserted vertically between two or more product modules.

4. The modular merchandise display of claim 1 further comprising a base deck to support the merchandise display frame.

5. The modular merchandise display of claim 4, wherein the base deck is also a storage space.

* * * * *